United States Patent [19]

Allen et al.

[11] 4,263,244

[45] Apr. 21, 1981

[54] PROCESS FOR SPINNING REGENERATED CELLULOSE FIBERS CONTAINING AN ALLOYING POLYMER

[75] Inventors: Thomas C. Allen; David B. Denning, both of Asheville, N.C.

[73] Assignee: Akzona Incorporated, Asheville, N.C.

[21] Appl. No.: 36,710

[22] Filed: May 7, 1979

Related U.S. Application Data

[63] Continuation-in-part of Ser. No. 872,519, Jan. 26, 1978, abandoned.

[51] Int. Cl.[3] ..... D01D 5/22; D01F 2/08

[52] U.S. Cl. ..... 264/168; 260/17.4 CL; 264/191

[58] Field of Search ..... 260/17.4 CL; 128/285; 264/191, 168, 188

[56] References Cited

U.S. PATENT DOCUMENTS

| | | | |
|---|---|---|---|
| 3,844,287 | 10/1974 | Smith | 128/285 |
| 4,066,584 | 1/1978 | Allen et al. | 128/284 |

FOREIGN PATENT DOCUMENTS

| | | | |
|---|---|---|---|
| 37-12014 | 8/1962 | Japan | 264/188 |
| 48-3649 | 2/1973 | Japan | 264/188 |

*Primary Examiner*—Jay H. Woo

*Attorney, Agent, or Firm*—Francis W. Young; Jack H. Hall

[57] ABSTRACT

A regenerated cellulose fiber containing an alloying polymer of acrylic acid or methacrylic acid, or a copolymer containing acrylic and methacrylic acid moieties or an alkali metal or ammonium salt thereof or other anionic alloying polymers or copolymer is prepared by a process wherein the alloying polymer is mixed with a viscose solution of known unreacted sodium hydroxide concentration, the sodium hydroxide concentration in the resulting mixture is increased to compensate for any loss in concentration due to neutralization and/or dilution effects by the addition of the alloying polymer to the viscose. Increasing the sodium hydroxide concentration greater than that required to restore the concentration to the original level has resulted in dramatic increases in absorbency. The resulting viscose solution is extruded into a spin bath in which the sulfuric acid concentration is reduced so that the resulting fibers will have at least 90% of the crimp of a fiber produced from the viscose solution without alloying polymer or copolymer.

23 Claims, No Drawings

PROCESS FOR SPINNING REGENERATED CELLULOSE FIBERS CONTAINING AN ALLOYING POLYMER

This application is a continuation-in-part of application Ser. No. 872,519 filed Jan. 26, 1978 now abandoned.

This invention relates generally to regenerated cellulose and, more particularly, to a regenerated cellulose fiber having improved water and body fluid absorbency and to a novel process for preparing the fiber.

In accordance with the viscose process, chemical cellulose from wood pulp or cotton linters is converted into regenerated cellulose or viscose rayon by a series of steps in which the cellulose is first treated with a sodium hydroxide solution to swell or mercerize it and to form alkali cellulose. The alkali cellulose, after aging, is reacted with carbon disulfide to form a soluble sodium xanthate derivative. The xanthated cellulose is later dissolved in dilute aqueous sodium hydroxide to form viscose which, after ripening, is spun by extrusion through a spinneret into a spin bath containing sulfuric acid and alkali metal and alkaline earth metal salts and other additives or modifiers which affect the coagulation of the streams of viscose solution and the regeneration of the cellulose xanthate to produce individual filaments of cellulose. These filaments may be collected as a cake or processed into a tow and cut into staple fibers.

Staple fibers prepared by the viscose process are used extensively in making articles which are used to absorb water and body fluids such as, for example, diapers, sanitary napkins, tampons, and the like. One method for producing staple fibers of regenerated cellulose having improved absorbency has been the uniform incorporation of alkali metal and ammonium salts of anionic polymers throughout the fiber structure, as illustrated in U.S. Pat. Nos. 3,844,287 and 4,066,584. In accordance with the disclosure in U.S. Pat. No. 3,844,287, a compatible polymer such as an alkali metal or ammonium salt of polyacrylic acid is mixed with the viscose solution before the solution is extruded. In accordance with the process disclosed in U.S. Pat. No. 4,066,584, even further improvement in absorbency and better processing are obtained by incorporating a copolymer of acrylic acid and methacrylic acid into the viscose. In accordance with the above disclosed processes, a caustic solution of the anionic polymer or copolymer is mixed with viscose, the mixture is spun into a conventional coagulating bath, purified, and dried, often with a lubricating finish thereon. Such staple alloy fibers are more absorbent than the non-alloyed regenerated cellulose fibers, but the introduction of the alloying polymer can create problems in processing of the fiber. Although a combination of factors may be the cause of these processing problems, one of the major causes is the loss of crimp encountered when the anionic alloying polymers are incorporated into the fiber structure. Crimp is important in both the purification of the fiber during its manufacture and during the utilization of the fiber during carding and formation into tampons and other formed products. In the purification step of rayon staple fibers where the cut fibers are contacted with large amounts of water, the fibers are held together in a mat on a belt. Although the absorbency of the fiber is increased as the amount of alloying polymer or copolymer in the fiber is increased, the processing difficulties during the purification step also increase due to the loss of integrity of the fiber mat. This tendency of the more absorbent staple fibers to come apart is thought to be due to the combined factors of increased swelling of the fiber in water and the loss of crimp. However, as the crimp of the more absorbent fiber is restored by the technique of this invention, the integrity of the fiber mat is maintained and the more absorbent fibers can be processed in the purification step with no more difficulty than encountered with ordinary rayon. In the case of processing the dried fiber into formed products for utilization of the more absorbent fibers, crimp is again important from the standpoint of imparting fiber to fiber cohesion to the fibrous structure so that the structure will hold together during processing. Again, as the amount of alloying polymer or copolymer in the fiber is increased, which usually increases the absorbency of the fiber, the amount of crimp lost increases, resulting in a decrease in cohesion properties. In addition, the tensile strength of the heretofore available alloy fibers is not as high as that of the non-alloyed fibers so nonwoven webs and tows containing such alloy fibers frequently break during processing. Also, although the heretofore available alloy fibers are more absorbent than non-alloyed fibers, a further increase in absorbency would be desirable if the processing disadvantages inherent with the prior art fibers were not substantially increased or could be eliminated. Furthermore, an increase in crimp of the alloyed fibers can result in an increase in absorbency of the resulting product due to restrictions on the collapse of the fibers in the absorbing product.

The formation of crimp in ordinary rayon is a well known process, with commercial rayon staple fibers being offered in a wide range of crimp values. A basic description of the formation of crimp in rayon staple fiber can be found in an article entitled "Theory and Morphology of Crimped Rayon Staple," by M. Horio and T. Kondo in TEXTILE RESEARCH JOURNAL, Volume 23, number 3, pages 137–151, March 1953. Although a number of viscose rayon process variables can affect the crimp, the basic method of producing a crimped rayon staple fiber is to spin the viscose solution into a coagulating spinbath of high salt content and a sulfuric acid content reduced to a point significantly lower than generally employed with non-crimped viscose rayon fibers. As explained in the above article, the hydrodynamics of the spinbath at the reduced acid concentration affect different portions of the fiber so that asymmetric cross sections are obtained. This difference in thickness of skin on different sides of the fiber gives each individual filament a strong tendency to coil, which is the motive force for producing crimp. When an alloying polymer or copolymer is added to the viscose solution to form a regenerated cellulose fiber under known crimping conditions of spinbath acid concentration, sodium and zinc sulfate concentration in the spinbath, fiber stretch, spinning speed, viscose alkali content, degree of xanthation, and maturity, the amount of crimp in the resulting fiber is significantly lower than in the comparative fiber produced under exactly the same conditions except with no alloying polymer or copolymer present. The amount of loss of crimp increases as the amount of alloying polymer or copolymer is increased. More crimp loss also results as the degree of neutralization of the alloying polymer is decreased. Examination of stained cross sections of viscose rayon fibers containing alloy polymers or copolymers show the same general serrated shape of viscose rayon fibers without the alloying polymer but without the characteristic unbalance in skin thickness. Since the anionic polymers or copolymers, which are now completely in the sodium salt form in the viscose-alloy mixture, utilize sulfuric acid in a manner similar to that of the sodium cellulose xanthate groups, one would be led to assume that the factors producing crimp would be enhanced. In fact, the addition of anionic polymers or copolymers decreases the crimp.

It is therefore an object of this invention to provide an alloy fiber of regenerated cellulose and an anionic polymer which imparts improved processing characteristics to the fiber having improved fluid absorbency. Another object of the invention is to provide an alloy fiber of regenerated cellulose and a polymer of acrylic acid or methacrylic acid or a copolymer consisting of or containing acrylic acid and/or methacrylic acid or alkali metal or ammonium salts thereof or a mixture thereof which is more easily processed in the purification step of manufacture and the formation of tampons and other formed products than the fibers containing such polymers or copolymers heretofore available. Still another object of the invention is to provide a process for making a fiber of regenerated cellulose and a polymer of acrylic acid or methacrylic acid or one of the aforesaid copolymers or alkali metal or ammonium salts or mixtures thereof having increased crimp and therefore improved processing characteristics and an improved absorbency for water and body fluids over non-alloyed regenerated cellulose fibers. A further object of the invention is to provide an improved alloy fiber containing cellulose and polyacrylic acid or a copolymer of acrylic acid and methacrylic acid or an alkali metal or ammonium salt thereof having improved uncompressed absorbency over previously known alloyed fibers.

The foregoing objects and others are accomplished in accordance with this invention, generally speaking, by providing a process for making alloy regenerated cellulose fibers wherein a polymer of acrylic acid or methacrylic acid, a copolymer consisting of or containing acrylic acid and/or methacrylic acid or other anionic polymer or copolymer or salts thereof or a mixture thereof is substantially uniformly mixed with a spinnable viscose solution, the sodium hydroxide concentration of the resulting mixture is increased to compensate for any loss in percentage concentration due to dilution and possibly neutralization effects by the addition of the alloying polymer to the viscose, and the mixture is spun into a spinning bath having a sulfuric acid concentration which is usually lower than the concentration which would be required for the spinning of the same viscose solution without the added polymer or copolymer. When the sodium hydroxide compensation is greater than 100% of that necessary to restore the concentration to that of the viscose before the addition of polymer, it is found that the fibers exhibit particularly high absorption in the uncompressed state as determined by the Demand Wettability Procedure. The crimped fibers of the invention can be processed as well as or better than non-alloyed regenerated cellulose staple fibers. The prior art alloy fibers have had a lower crimp which accounts for the difficulty in processing them. The crimped alloy fibers provided by using the condition of the invention can be substantially more absorbent than the prior art fibers having lower crimp.

In practicing the invention, a viscose solution may be first prepared by conventional steps as described under Rayon in the Encyclopedia of Polymer Science and Technology, Volume 11, published by John Wiley and Sons, Copyright 1969. This may include steeping conventional chemical cellulose sheet prepared from wood pulp or cotton linters in a caustic soda solution (NaOH) and thereafter removing caustic soda by pressing, or the like, to the desired solids content. The resulting alkali cellulose is shredded and, after aging, is charged to a suitable vessel where it is mixed with carbon disulfide to form an aqueous alkaline xanthate (viscose) solution. For the best results, the concentration of the viscose solution is from about 6% to about 10% by weight cellulose, from about 4% to about 8% by weight sodium hydroxide, from about 1.5% to about 3% sulfur added as carbon disulfide and the remainder water. One of the aforesaid polymers or copolymers, or a mixture thereof, is mixed with the viscose solution in an amount of from about 2.5% to about 35% by weight polymer based on the weight of cellulose in the solution. The alloying polymer or copolymer may be mixed with an equal molar amount of sodium hydroxide in an aqueous solution and then added as the fully neutralized sodium salt to the viscose solution, preferably by injection just before the viscose solution is extruded. Alternately, the alloying polymer or copolymer may be added to the viscose solution with partial or no neutralization.

Regardless of the degree of neutralization of the alloying polymer or copolymer, some extra sodium hydroxide must be added, preferably when the original sodium hydroxide is added in the dissolving step. However, it may under certain circumstances be advantageous to add the extra sodium hydroxide with, or even after, the alloying polymer or copolymer. The amount of extra sodium hydroxide to be added will be smaller as (1) the degree of neutralization of the added polymer to the sodium salt form increases, (2) the concentration of the solution of polymer added increases, (3) the amount of polymer added decreases. It also appears that as the concentration of sodium hydroxide in the original viscose solution increases, less extra sodium hydroxide will have to be added.

The resulting mixture of viscose solution and neutralized polymer or copolymer is extruded through a spinneret into a spin bath where it is coagulated to form a partially regenerated cellulose filament. The acid concentration of the spinbath is adjusted to a point where a fiber having satisfactory crimp is produced. This usually requires that the acid concentration be lower than would be required for spinning the same viscose solution without the polymer or copolymer additive to produce a similarly crimped fiber.

The optimum acid and alkali concentration must be determined experimentally by continuing to change each until the desired crimp is obtained, since a number of viscose rayon process variables, such as viscose maturity, spinning speed, stretch, other viscose and spin bath additives, spin bath and second bath temperatures and the like, which will be different with different processing conditions can affect the crimp. In any event, in accordance with this invention, the sodium hydroxide concentration in the viscose solution containing the alloying polymer or copolymer is to have, at the time of extrusion, a sodium hydroxide concentration generally, of at least 95% of the sodium hydroxide concentration required in the viscose solution without alloying polymer or copolymer, up to about 125% and, preferably, in the range of 95% to 110%, and the spin bath sulfuric acid concentration should be about 0 to 25%, and, preferably about 5 to 25%, lower than would be required to produce a fiber from the viscose solution without the additive in order to produce an alloy fiber having at least 90% of the crimp count of the comparable non-alloy fiber or the crimp necessary for proper processing of the fiber.

As stated above, it has been found that the problem of loss of crimp in alloyed rayon fibers inherent in the prior art processes can be solved by increasing the alkali metal hydroxide concentration in the viscose solution. Furthermore, it is usually necessary to decrease the sulfuric acid concentration in the spin bath into which the viscose solution is extruded or spun. In the prior art processes wherein an alloying compound is added to a viscose solution to improve the absorbency of the resulting fiber and in articles made therefrom, the crimp of the alloyed fiber is less than the crimp of a non-alloyed fiber produced from the same viscose solution but without an alloying compound. Hence, the alloy fibers of the prior art have had fewer crimps per inch than non-alloyed fibers produced under the same processing conditions. In some processes for making articles of manufacture from the alloyed fibers the reduced crimp can be tolerated but in many processes for making tampons and other fluid absorbent articles, the alloy fiber causes considerable inconvenience during both manufacture and processing or cannot even be manufactured or used in some conventional processing or manufacturing apparatus. In accordance with this invention, a process is provided for substantially restoring the crimp of the alloy fiber to the extent that it is substantially equal to or more than that of a fiber produced by the same methods from the same viscose solution but without an alloying compound. Hence, the invention provides a rayon fiber having improved fluid absorbency or retention plus an improved crimp and attendant improved processing characteristics.

It has been known in the art that the crimp of an ordinary non-alloyed rayon fiber will vary with the amount of sulfuric acid in the spin bath. As demonstrated in Examples 4 and 5, the crimp of a non-alloyed rayon fiber is definitely increased with a decrease in sulfuric acid concentration in the spin bath and increased only slightly with significant increases in sodium hydroxide concentration in the viscose. Contrary to this past knowledge, it has been found that the crimp of an alloyed rayon fiber is significantly increased with increase of sodium hydroxide in the viscose solution, especially when it is combined with a decrease in acidity in the spin bath. The necessity of decreasing the spinbath acid concentration depends to some extent upon the extent of neutralization of the added polymer or copolymer and the amount of excess alkali added. For example, in Example 9A it is seen that a decrease in sulfuric acid concentration is necessary to increase the crimp when 15 percent by weight based on the weight of cellulose of a 50—50 copolymer of acrylic and methacrylic acids about 45 percent neutralized (in the sodium salt form) is added to a viscose solution containing compensating sodium hydroxide. In example 9B, using the same copolymer and alkali compensated viscose as in 9A, but with the copolymer 100% neutralized, gives a higher crimp than in Example 9A without reducing the acid. Reducing the spinbath acid first gives a higher crimp while further acid reduction gives a lower crimp. In Example 9C where excess sodium hydroxide in addition to the fully neutralized copolymer is added to the same alkali-compensated viscose as in Example 9B, no increase in crimp is obtained with reduction in spinbath acid concentration. While these data, plus the comparisons of Examples 6, 7, and 8 demonstrate that the crimp of alloyed rayon fibers can be improved by increasing the sodium hydroxide concentration of the viscose solution, the improvement is usually much more pronounced when both the sodium hydroxide concentration in the viscose solution is increased and the sulfuric acid concentration of the spin bath is decreased even though decrease alone of sulfuric acid concentration in practical amounts in the spin bath appears to have little effect on the crimp of an alloyed fiber. For this reason, inter alia, it is preferred to both increase the alkali metal hydroxide concentration in the viscose solution and decrease the sulfuric acid concentration in the spin bath.

As stated on page 138 of "Textile Research Journal" for March, 1953, in an article entitled "Theory and Morphology of Crimped Rayon Staples, " it has been the practice in the past when extruding a viscose solution to use greater amounts of acid in the spin bath with alkali-rich viscose and smaller amounts of acid when an alkali-poor viscose is used. Hence, the discovery that concentration of the acid in the spin bath should remain constant or be decreased when the sodium hydroxide content of the viscose solution is increased with the addition of polymer or copolymer to increase the crimp, thus improving the processing characteristics, and to increase the absorbency of the fiber is contrary to the practice in spinning a viscose solution which does not contain an anionic alloying polymer additive.

The sodium hydroxide concentration required in the viscose and the sulfuric acid concentration required in the aqueous spin bath to produce an alloy fiber having an acceptable crimp varies somewhat depending upon other variables such as the amount and kind of alloying polymer or copolymer used. However, the results obtained so far indicate that while the number of crimps per inch of an alloyed fiber containing from 5% to 25% by weight of the polymers or copolymers disclosed herein can be restored at least to some significant extent by increasing the sodium hydroxide concentration, best results are obtained when the sulfuric acid concentration in the spin bath is reduced too.

There is a relationship between the increase in sodium hydroxide concentration in the viscose and the sulfuric acid concentration in the spin bath. Data presently available indicate that the ratio of concentration of sulfuric acid in the spin bath to concentration of sodium hydroxide in the viscose after the alloy polymer is added should be lower than the ratio that is obtained with alloying polymer without compensating for loss of alkali concentration in the viscose. To obtain the level of crimp that was present in the fiber before alloying polymer was added, it is generally necessary to lower the ratio to the value obtained before the alloying polymer was added, or lower. In practicing the invention, the ratio is lowered first by increasing the alkali concentration to compensate for the loss in alkali concentration caused by the addition of alloying polymer. Then the acid concentration is adjusted, usually lower, until the maximum crimp is obtained. If this ratio becomes too low, however, then the crimp may be further reduced or the bottom spinning limit of sulfuric acid concentration may be reached. The acid:alkali ratio has been found to vary with the absolute concentration of alkali used in the viscose without alloying fiber and with the spinning speed as well as other variables in the viscose rayon process. For example, for viscose processes using 4.8% alkali, a ratio of 0.9 to 1.1 is generally optimum. For other alkali concentrations, the ratio for achieving optimum crimp will differ and can be determined according to the above principles. The invention is illustrated by the following typical examples in which all parts are by weight unless otherwise specified. In each of the following examples, except Example 11, the figures under the heading marked "Sodium Hydroxide in Viscose After Addition of Polymer" are calculated values based on the dilution and neutralization effects of adding the polymers to the viscose.

EXAMPLES 1A and 1B

In Example 1A, a control fiber, an ordinary 3.0 denier by 1 9/16 inch non-alloy viscose rayon fiber, suitable for high speed carding and processing into tampons and other nonwoven products is made by spinning a ripened viscose, containing about 8.5% cellulose, about 4.8% sodium hydroxide, about 2.3% total sulfur, and about 1% titanium dioxide at a sodium dithiocarbonate degree of substitution of about 0.42 and an ammonium chloride coagulation maturity of about 11 cc is extruded through a spinneret into an acid spin bath containing about 5.8% sulfuric acid, about 24% sodium sulfate, about 0.95% zinc sulfate, and about 30 parts per million of lauryl pyridinium chloride. The temperature of the spin bath is about 57° C. The resulting collection of filaments is removed from the spin bath, stretched as a tow about 36% in air, run through an aqueous bath at about 95° C. containing about 3.2% sulfuric acid and about 6.15% total salts. The tow is stretched about 18% in the aqueous bath, and then is cut into staple fibers having a length of about 1 9/16 inch. The spinning speed for this process is about 120 meters per minute.

The staple fiber is washed with water, then with an aqueous solution containing about 0.3% sodium sulfide and 0.04% sodium hydroxide, washed with water, bleached with a solution containing about 0.175% alkaline sodium hypochlorite solution, washed with water, washed with an aqueous solution of about 0.1% sodium thiosulfate, washed with water several times, finished in an aqueous bath containing about 0.3% polysorbate 20 (ethoxylated sorbitan monolaurate), and dried in a heated oven. The temperature of the oven is adjusted to provide a moisture content of about 11% by weight in the dried staple fiber. The fiber is now ready for processing into one of the absorbent products mentioned earlier.

The resulting fiber has an average crimp count, determined on several samples, of 18.0 crimps per inch, and a secondary swelling in water of 81%. The approximate ratio of sulfuric acid in the spin bath to alkali concentration in the viscose, is about 1.21. The uncompressed demand wettability of the fiber is 10.7 ml. per gram.

In Example 1B, a non-bleached control fiber is produced, where the sodium hypochlorite bleach solution is replaced by an aqueous sulfuric acid solution of about 0.18%, and the sodium thiosulfate solution is omitted. This fiber also has an average crimp count of 18.0 crimps per inch.

EXAMPLES 2A and 2B

In order to demonstrate how the addition of the alloying anionic polymers and copolymers added to the viscose reduce the crimp of the resulting fiber, Example 1B is repeated except the spinbath sulfuric acid is reduced to 5.45%, and an aqueous sodium bicarbonate solution rinse is added following the dilute sulfuric acid rinse both to adjust the pH of the fiber and to obtain the proper degree of neutralization of the carboxylic acid groups to optimize absorbency and physicological properties of the fiber for use in tampons and similar products.

In Example 2A, 5%, based on the weight of the cellulose in the viscose (CiV), of a homopolymer of polyacrylic acid (Acrysol A-3 from Rohm and Haas) partially neutralized with sodium hydroxide to about 40% is added to the viscose prior to spinning. The subsequent complete neutralization of the polyacrylic acid and the dilution effect reduces the sodium hydroxide concentration in the alloy-viscose mixture to about 4.56%.

In Example 2B, 15% CiV of a 50/50 by weight copolymer of acrylic acid and methacrylic acid partially neutralized to about 45% with sodium hydroxide is added to the viscose. The resulting neutralization and dilution effects reduce the sodium hydroxide concentration in the viscose-alloy mixture to about 4.13%. In the following table, and throughout, the acid to alkali ratio given is the ratio calculated from approximate values (middle limits) of the specified acid and alkali concentrations, except that in Examples 5 and 11, the ratios were calculated from actual analytical data. Also, Demand Wettability of the fibers in the uncompressed state is given in the tables under the heading "Uncomp. D.W. (ml.g.)". Analysis of the resulting fibers gave the following results:

| Example | Approximate Acid:Alkali Ratio | Crimps per inch | Secondary Swelling % | Uncomp.D.W. (ml./g.) |
|---|---|---|---|---|
| 1A | 1.21 | 18.0 | 81 | 10.7 |
| 2A | 1.20 | 16.4 | 115 | — |
| 2B | 1.32 | 13.6 | 125 | 11.0 |

EXAMPLES 3A, 3B and 3C

These examples demonstrate how the crimp lost in Example 2B can be restored by increasing the alkali concentration in the viscose and reducing the spin bath acid concentration.

In Example 3A, Example 2B is repeated except the sodium hydroxide concentration in the viscose is increased to 5.1% before the copolymer is added and the spin bath acid is reduced to 5.1%. The calculated sodium hydroxide concentration of the copolymer-viscose mixture prior to spinning is about 4.43%.

In Example 3B, Example 3A is repeated except that the copolymer of acrylic acid and methacrylic acid is completely neutralized with sodium hydroxide prior to addition to the viscose, the bleaching procedure of Example 1A is employed and no finish is applied. A dilute acid rinse follows a sodium thiosulfate rinse to reduce the fiber pH to a level satisfactory for tampon and similar use. The calculated sodium hydroxide concentration of the alloy-viscose mixture is about 4.76%.

In Example 3C, Example 3B is repeated except that the volume of fiber production is increased several times. It was found necessary to increase the spinbath acid concentration to 5.3% in order to obtain proper satisfactory spinning performance.

The resulting fibers have the following properties:

| Example | Approx. Acid:Alkali Ratio | Crimps per inch | Uncomp. D.W. (ml./g.) |
|---|---|---|---|
| 3A | 1.15 | 17.5 | 13.2 |
| 3B | 1.07 | 19.2 | — |
| 3C | 0.96 | 17.2 | — |

EXAMPLES 4A, AND 4B

In order to demonstrate the effect of decreasing the sulfuric acid in the spin bath when spinning a viscose solution which does not contain an alloying polymer or the like, in Example 4, Example 1B is repeated except at about one half the spinning speed at a much lower volume of fiber production.

A. In example 4A, the sodium hydroxide concentration of the viscose solution is 4.8% based on the weight of the viscose. The viscose solution is extruded into an aqueous spin bath containing 5.86% sulfuric acid. The crimp of the dried fiber after processing as described in Example 1B is 20.4. The uncompressed Demand Wettability of the fiber is 9.9 ml. per gram.

B. In Example 4B, the sodium hydroxide concentration of the viscose solution is 4.8% based on the weight of the viscose. The viscose solution is extruded into an aqueous solution containing 4.97% sulfuric acid. The crimp of the resulting fiber is 25.3 and the uncompressed Demand Wettability is 10.7 ml. per gram.

EXAMPLES 5A THROUGH 5E

These examples demonstrate the effect of increasing the sodium hydroxide concentration in a viscose solution which does not contain an alloying polymer. The processing of the filaments into fibers is the same as in Example 4B using the sodium hydroxide concentrations and sulfuric acid concentrations shown below. As seen in the table below, increasing the alkali concentration has very little effect on, and can also decrease the crimp of non-alloyed fibers.

| Example | Sodium Hydroxide In Viscose | Approximate Acid:Alkali Ratio | Sulfuric Acid Concen. in Spin Bath | Crimps per Inch |
|---|---|---|---|---|
| 5A | 4.82 | 1.07 | 5.15 | 25.3 |
| 5B | 5.03 | 1.02 | 5.12 | 26.6 |
| 5C | 5.17 | 1.02 | 5.29 | 21.2 |
| 5D | 5.25 | 1.00 | 5.26 | 21.9 |
| 5E | 5.41 | 1.07 | 5.78 | 23.0 |

EXAMPLES 6A THROUGH 6D

Examples 4A is repeated except the sulfuric acid concentration of the spin bath is varied and the viscose solution contains 15% by weight based on the weight of cellulose of a 50—50 copolymer of acrylic acid and methacrylic acid. The copolymer is mixed with sufficient sodium hydroxide to effect about 45% neutralization before it is added to the viscose. The sodium hydroxide in the viscose solution is 4.82% before the addition of a 50—50 copolymer of acrylic acid and methacrylic acid and is reduced to 4.1% by the copolymer addition. The crimp is not restored to the level of Example 4A, even though the acid concentration is reduced, in the manner taught by the prior art, to 4.25%, which is at about the lower limit for spinning fiber under these conditions.

| Example | Approximate Acid:Alkali Ratio | Sulfuric Acid Conc. in Spin Bath | Crimp |
|---|---|---|---|
| 6A | 1.34 | 5.5 | 16.4 |
| 6B | 1.22 | 5.0 | 16.1 |
| 6C | 1.16 | 4.75 | 15.7 |
| 6D | 1.04 | 4.25 | 19.4 |

EXAMPLES 7A THROUGH 7C

Example 6A is repeated except the sodium hydroxide concentration in the viscose is varied. The concentration of sulfuric acid is kept constant at about 5.5%.

| Example | Sodium Hydroxide Concentration in Viscose | | Crimp/ Inch | Uncomp.D.W. (ml./g.) |
|---|---|---|---|---|
| | Before Addition of Copolymer | After Addition of Copolymer | | |
| 7A | 4.8 | 4.1 | 16.4 | 11.0 |
| 7B | 5.3 | 4.6 | 18.0 | 10.7 |
| 7C | 5.8 | 5.4 | 26.4 | 13.4 |

EXAMPLES 8A THROUGH 8J

Example 6A is repeated except the alkali in the viscose is increased and varied and the concentration of sulfuric acid in the spin bath is decreased and varied.

| Example | Conc. of Sulfuric Acid in Spin Bath | Conc. of Sodium Hydroxide in Viscose | | Approx. Acid:Alkali Ratio | Crimps/ inch |
|---|---|---|---|---|---|
| | | Before | After | | |
| 8A | 5.5 | 5.3 | 4.6 | 1.20 | 18.0 |
| 8B | 5.5 | 5.8 | 5.4 | 1.02 | 26.4 |
| 8C | 5.0 | 5.3 | 4.6 | 1.09 | 24.4 |
| 8D | 5.0 | 5.8 | 5.4 | 0.93 | 26.4 |
| 8E | 4.75 | 5.3 | 4.6 | 1.03 | 23.6 |
| 8F | 4.75 | 5.8 | 5.4 | 0.88 | 24.2 |
| 8G | 4.50 | 5.3 | 4.6 | 0.99 | 22.2 |
| 8H | 4.50 | 5.8 | 5.4 | 0.83 | 23.5 |
| 8I | 4.25 | 5.3 | 4.6 | 0.92 | 20.8 |
| 8J | 4.00 | 5.8 | 5.4 | 0.74 | 21.1 |

| Example | Uncomp. D.W.(ml./g.) |
|---|---|
| 8A | 10.7 |
| 8B | 13.4 |
| 8C | 11.6 |
| 8D | 13.2 |

As seen from Examples 8D and 8D, where the alkali concentration in the viscose at the spinning point is 112.5% of the concentration used with the non-alloyed control (Ex. 4), a significant increase in the Demand Wettability of the uncompressed fiber results.

EXAMPLES 9A, 9B, 9C AND 9D

These examples demonstrate the preparation of a cellulose fiber containing 15% by weight, based on the weight of cellulose, of a copolymer of acrylic acid and methacrylic acid.

A. Example 6A is repeated except that the sodium hydroxide concentration of the viscose before the copolymer is added is increased to 5.3%. The viscose is spun in aqueous spinbaths containing varying concentrations of sulfuric acid.

B. Example 9A is repeated except the copolymer is 100% neutralized with sodium hydroxide.

C. Example 9B is repeated except that excess sodium hydroxide above that required for complete neutralization is added to the copolymer before it is added to the viscose solution.

D. Example 9A is repeated except no copolymer or polymer is added to the viscose. The viscose contains 4.8% sodium hydroxide. The viscose is spun into an aqueous spinbath containing 5.5% sulfuric acid.

| Example | Conc. of Sulf. Acid In Spin Bath | Conc. of NaOH in Viscose Before | Conc. of NaOH in Viscose After | Approx. Acid:Alkali Ratio | Crimps/ Inch |
|---|---|---|---|---|---|
| 9A | 5.5 | 5.3 | 4.62 | 1.19 | 20.6 |
| | 5.0 | 5.3 | 4.62 | 1.08 | 26.8 |
| | 4.5 | 5.3 | 4.62 | 0.97 | 29.3 |
| 9B | 5.5 | 5.3 | 4.92 | 1.12 | 23.0 |
| | 5.0 | 5.3 | 4.92 | 1.02 | 29.0 |
| | 4.5 | 5.3 | 4.92 | 0.91 | 23.4 |
| 9C | 5.5 | 5.3 | 5.02 | 1.10 | 26.3 |
| | 5.0 | 5.3 | 5.02 | 1.00 | 26.6 |
| | 4.5 | 5.3 | 5.02 | 0.90 | 23.4 |
| 9D (Control) | 5.5 | 4.8 | 4.8 | 1.15 | 22.0 |

EXAMPLES 10A THROUGH 10F

These examples demonstrate the effect of increasing the sodium hydroxide in viscose containing 15% by weight of a homopolymer of acrylic acid and decreasing the acid. The procedure of Example 9 is repeated. It is observed that with an increase of alkali to only 5.3% that the crimp does not return to at least 90% of the original crimp until the acid is reduced to 4.75% as shown in Example 10F.

A. No polymer or copolymer is included in the viscose. The viscose solution contains 4.8% sodium hydroxide and is spun into an aqueous spin bath containing 5.5% sulfuric acid. The fiber has 23.4 crimps per inch. The secondary swelling is 79%.

B. About 15% of a homopolymer of acrylic acid is added to the viscose. The homopolymer is about 40% neutralized with sodium hydroxide. The unreacted sodium hydroxide in the viscose before the polymer is added is 4.8% and 4.2% after the polymer The spinbath sulfuric acid concentration is about 5.5%. The fiber has 15.8 crimps per inch. The secondary swelling is 141%.

C. Example 10B is repeated except the homopolymer is 100% neutralized. The sodium hydroxide concentration in the viscose is 4.8% before the polymer is added and 4.5% after it is added. The viscose is spun in an aqueous spin bath containing 5.5% sulfuric acid. The fiber has 18.0 crimps per inch. The secondary swelling is 143%.

D, E and F. Example 10B is repeated. The viscose contains 5.3% unreacted sodium hydroxide before and 4.8% after the addition of the homopolymer. The spin bath contains sulfuric acid in the amounts indicated below. The number of crimps per inch in the fibers and the secondary swelling values are also given below:

| Example | Sulfuric Acid in Spin Bath | Approx. Acid: Alkali Ratio | Crimps/ Inch | Secondary Swelling(%) |
|---|---|---|---|---|
| 10D | 5.5 | 1.15 | 16.3 | 165 |
| 10E | 5.0 | 1.04 | 20.4 | — |
| 10F | 4.75 | 0.99 | 23.6 | 173 |

EXAMPLE 11

This example illustrates the applicability of the invention at a much higher initial sodium hydroxide concentration in the viscose, such as illustrated in U.S. Pat. No. 3,844,287.

In Example 11A, the Example of U.S. Pat. No. 3,844,287 but containing no alloying polymer, is followed closely as to alkali concentration in the viscose and acid concentration in the bath, but other constants, which do not affect the crimp comparison, were as stated herein. A viscose solution containing about 9 percent cellulose, 2.45 percent sulfur and 5.10 percent sodium hydroxide having a ball fall viscosity of about 46 seconds and a coagulation index in ammonium chloride solution of about 11 cc. was spun into a spinbath containing about 7.5 percent sulfuric acid, 24% sodium sulfate, and 0.95% zinc sulfate plus about 30 ppm lauryl pyridinium chloride. Prior to spinning, 0.9% CiV of a solution of 22.25% aqueous sodium hydroxide was injected into the viscose solution to increase the sodium hydroxide concentration in the viscose solution to about 6.0 percent prior to spinning.

In Example 11B, to duplicate closely the alloy fiber of U.S. Pat. No. 3,844,287 containing sodium polyacrylate, Example 11A was repeated, except that 20% CiV (based on the weight of the cellulose in viscose) of sodium polyacrylate was added to the viscose to spinning into the viscose. The sodium polyacrylate solution was 12.5 percent active based on the complete sodium salt of polyacrylic acid and had a Brookfield viscosity of about 200 cps. and a specific gravity of 1.080.

In Example 11C, representing the practice of the invention described here, Example 11B was repeated except that 0.9% CiV extra 22.25% sodium hydroxide solution above the amount in Example 11A (a total of 1.8 percent CiV) was added to the viscose to compensate for the loss in concentration due to dilution.

The results of the evaluations of the fibers from Examples 11A, B, and C are given below.

| Example | Final Conc. of Sulfuric Acid in Spinbath | Conc. of Sodium Hydroxide in Viscose before Spinning | Approx. Acid:Alkali Ratio | Crimps per Inch | Uncomp. D.W. (ml/gms) |
|---|---|---|---|---|---|
| 11A | 7.58 | 5.94 | 1.28 | 18.35 | 10.10 |
| 11B | 7.54 | 5.28 | 1.43 | 16.7 | 10.33 |
| 11C | 7.55 | 5.95 | 1.27 | 18.3 | 12.87 |

PROCEDURE FOR DETERMINING % SECONDARY SWELLING ("Q") OF RAYON FIBERS (WATER RETENTION)

After soaking 2 to 3 g of previously washed and dried rayon fiber in water, the excess water is removed by centrifuging at a force of 2500 to 3500 times gravity for 15 minutes in stainless steel sample holders. These holders are 22 mm. I.D.×25 mm. deep, with screw caps to cover both ends. Space is provided in the centrifuge cup below the sample holder to contain the excess water which is removed from the yarn during centrifuging. The extracted fiber is placed in a preweighed weighing bottle; the weight of the swollen fiber is obtained and, after drying overnight at 105° C., the weight of the dry fiber is obtained. The percent swelling is then determined by use of the following equation.

$$Q = \frac{\text{Swollen weight} - \text{dry weight}}{\text{dry weight}} \times 100$$

PROCEDURE FOR DETERMINING DEMAND WETTABILITY

The Demand Wettability results are determined in accordance with the procedure described in U.S. Pat. No. 4,066,584, using a 1% saline solution. The following procedure is used for preparing the samples:

The fiber sample is carded two times on a laboratory card and collected in layers to a thickness where 2×2 inch squares weigh approximately 1.5 grams. The 2×2 inch square is then placed on a demand wettability apparatus under a 2×2 inch square metal plate of a weight to exert 0.1 pounds per square inch on the sample

PROCEDURE FOR DETERMINING CRIMP OF A RAYON STAPLE FIBER

The fiber crimp is determined as follows:

I. Equipment

A. Velvet covered mounting board measuring 8¼"×4"

B. Cover glass measuring 8¼"×4"

C. Scotch tape

D. Ruler

II. Crimp Count Procedure

A. Prepare mounting board to receive fiber by laying out 2 parallel strips of scotch tape the proper distance apart as determined by the gauge length specified below.

| Fiber Length | Gauge Length |
|---|---|
| less than 1½" | ¾" |
| 1½" to 2" | 1" |
| 3" | 2" |
| greater than 3" | 3" |

B. Lay the 25 fibers out in a relaxed position, in groups of five, parallel to each other and approximately ¼" apart. Allow ½" between groups.

C. Place the cover glass over the velvet board.

D. Count and record the number of peaks and valleys made by the fiber between the 2 pieces of scotch tape.

E. Average and report as crimps per inch.

It is advisable in order to avoid inconsistencies in the crimp count to have the same person determine the crimp on both the control sample and the experimental samples.

The sample fiber provided by the invention can be used in various types of absorbent articles such as diapers, sanitary napkins and tampons prepared by conventional procedures for making such products.

In the foregoing examples, where a 50/50 acrylic acid/methacrylic acid copolymer is used, it is to be understood that a copolymer of various mixtures of the two monomers may be used, preferably of from about 10% to about 90% of one and the balance of the other monomer.

The invention has been described with respect to the sodium salt of a polyacrylic acid or a sodium salt of a copolymer of acrylic acid and methacrylic acid for the sake of convenience, but it is to be understood that other alkali metal salts such as potassium, lithium and the like are contemplated, but the sodium salt is preferred.

Although the invention is described in detail for the purpose of illustration, it is to be understood that such detail is solely for that purpose and that variations can be made therein by those skilled in the art without departing from the spirit and scope of the invention except as it may be limited by the claims.

What is claimed is:

1. In a process for making regenerated cellulose fibers containing an alloying polymer of acrylic acid or methacrylic acid, or an alloying copolymer containing acrylic acid and methacrylic acid moieties, an alkali metal salt or ammonium salt thereof, or a mixture thereof, the improved method for making a crimped fiber which comprises mixing the alloying material with a viscose solution containing about 4% to about 8% by weight unreacted sodium hydroxide, maintaining the sodium hydroxide in the mixture at a concentration which is at least 95% as high as it was in the viscose solution without alloying material, and spinning the viscose solution containing said alloying polymer, copolymer or salt.

2. The process of claim 1 wherein the said mixture is spun into a spin bath which contains sulfuric acid.

3. The process of claim 2 wherein the spin bath contains from about 80% by weight to about 95% by weight of the sulfuric acid required to produce the crimp that would be obtained with the viscose without said polymer, copolymer, or salt, whereby a fiber is obtained having at least 90% of the crimp of the fiber produced from the viscose without said polymer, copolymer or salt.

4. The process of clam 1 wherein the sodium hydroxide concentration based on the weight of viscose is from about 95% to about 125% of the concentration without the polymer or copolymer.

5. The process of claim 1 wherein the sodium hydroxide concentration after the addition of the alloying polymer or copolymer is from 95% to 110% of the concentration of sodium hydroxide in the non-alloyed viscose solution before the polymer or copolymer is added and the concentration of the sulfuric acid in the spin bath is 5% to 25% less than the concentration of sulfuric acid required in the spin bath to produce at least 90% of the crimp which would be obtained from said non-alloyed viscose solution.

6. The process of claim 1 wherein the alloying material is an alkali metal salt of a homopolymer of acrylic acid or a copolymer of acrylic acid and methacrylic acid.

7. The process of claim 1 wherein the sodium hydroxide is added to the viscose solution before the alloying material is added.

8. The process of claim 1 wherein from about 10% to about 20% by weight of the alloying material based on the weight of cellulose in the viscose solution is mixed with the viscose solution.

9. In a process for making regenerated cellulose fibers containing an alkali metal salt of polyacrylic acid, or an alkali metal salt of a copolymer of acrylic acid and methacrylic acid, or a mixture thereof, the improved method for making a crimped fiber which comprises mixing the polymer or copolymer with a viscose solution containing about 4–8% sodium hydroxide which upon extrusion, coagulation, regeneration and purification produces a crimped fiber, maintaining the sodium hydroxide concentration in the resulting mixture at a concentration which is at least as high as it was in the viscose solution before the polymer or copolymer was mixed therewith and at a concentration whereby dried, purified fibers, produced therefrom by the same process as used in preparing the fibers from the said viscose solution without polymer or copolymer, have a crimp which is at least 90% of the crimps per inch produced by the viscose solution prior to mixing with the polymer or copolymer.

10. In a process for making regenerated cellulose fibers containing as an alloying agent an alkali metal salt of polyacrylic acid, an alkali metal salt of a copolymer of acrylic acid and methacrylic acid, or a mixture thereof, the method for making an alloyed cellulose fiber having an improved crimp which comprises mixing the said polymer or copolymer with a viscose solution containing sodium hydroxide, adding sodium hydroxide to the resulting mixture to replenish the sodium hydroxide to a concentration at least equal to that of the viscose prior to the addition of the alloying agent and thereby restore any crimp lost because of the addition and spinning the resulting viscose mixture in a spin bath containing sulfuric acid.

11. In a process for making an alloyed regenerated cellulose fiber having improved absorbency, the method for making such a fiber also having improved processing characteristics which comprises mixing (1) a first spinnable viscose solution which contains unreacted sodium hydroxide and which when spun into a spin bath containing sulfuric acid produces a non-alloyed crimped regenerated cellulose fiber having at least 18 crimps per inch, with (2) from about 2.5% to about 35% by weight of an alloying homopolymer or an alloying copolymer, or an alkali metal salt or an ammonium salt of said polymer or copolymer, or a mixture thereof, in an amount whereby a fiber spun into said spinbath has a crimp of less than 18 crimps per inch, adjusting the unreacted sodium hydroxide concentration of the viscose solution or the resulting mixture to a concentration whereby a fiber spun from the mixture has a crimp of at least 18 crimps per inch and is from about 4% to about 8% by weight, and of substantially the same composition as said first spinnable viscose solution and having a crimp of at least 18 crimps per inch.

12. The process of claim 11 wherein the sulfuric acid concentration of said aqueous solution is from about 0 to 25% lower than the sulfuric acid concentration required to produce a regenerated cellulose fiber having a crimp of at least 18 crimps per inch when spinning said first spinnable viscose solution.

13. The process of claim 1 wherein the sodium hydroxide required in the said mixture is added when the said first viscose solution is prepared and before the said alloying polymer or copolymer is mixed with the viscose solution.

14. The process of claim 1 wherein sodium hydroxide is added substantially simultaneously with or after the alloying material is in the viscose solution.

15. The process of claim 9 wherein a viscose solution containing said alloying polymer or copolymer and unreacted sodium hydroxide is prepared and the concentration of the sulfuric acid in the aqueous spin bath is decreased until regenerated fibers spun from the resulting viscose solution have a crimp of at least 18 crimps per inch.

16. The process of claim 11 wherein the sodium hydroxide concentration in the viscose solution at the time it is spun to form the fiber contains at least 95% of the sodium hydroxide concentration of said first spinnable viscose solution.

17. The process of claim 16 wherein the acid concentration in said aqueous solution is about 0 to 25% lower than would be required to produce a crimped fiber from the said first spinnable viscose solution.

18. The process of claim 11 wherein said alloying homopolymer or copolymer is fully neutralized before being added to said viscose.

19. In a process for making regenerated cellulose fibers containing an alloying polymer of acrylic acid or methacrylic acid, or an alloying copolymer containing acrylic acid and methacrylic acid moieties, an alkali metal salt or ammonium salt thereof, or a mixture thereof, the improved method for making a highly absorbent crimped fiber in the uncompressed state which comprises mixing the alloying material with a viscose solution containing about 4% to about 8% by weight unreacted sodium hydroxide, increasing the sodium hydroxide in the mixture to a concentration which is greater than it was in the viscose solution without alloying material, and spinning the viscose solution containing said alloying polymer or copolymer salt.

20. The process of claim 19 wherein the spin bath contains sulfuric acid in an amount from about 80% by weight to about 95% by weight of the sulfuric acid required to produce the crimp that would be obtained with the viscose without said polymer, copolymer, or salt, whereby a fiber is obtained having at least 90% of the crimp of the fiber produced from the viscose without said polymer, copolymer or salt.

21. The process of claim 19 wherein the sodium hydroxide concentration based on the weight of viscose is from about 95% to about 125% of the concentration without the polymer or copolymer.

22. The process of claim 19 wherein the sodium hydroxide concentration after the addition of the alloying polymer or copolymer is from 95% to 110% of the concentration of sodium hydroxide in the non-alloyed viscose solution before the polymer or copolymer is added and the concentration of the sulfuric acid in the spin bath is 5% to 25% less than the concentration of sulfuric acid in the spin bath required in the spin bath to produce at least 90% of the crimp which would be obtained from said non-alloyed viscose solution.

23. The process of claim 11 wherein said alloying homopolymer or copolymer is unneutralized or only partially neutralized before being added to said viscose.

* * * * *